US006165345A

United States Patent [19]

Updegrove et al.

[11] Patent Number: 6,165,345

[45] Date of Patent: Dec. 26, 2000

[54] ELECTROCHEMICAL STRIPPING OF TURBINE BLADES

[75] Inventors: Kevin Updegrove, Carson City; Frank Goodwater, Reno; William Fay, Silver Springs, all of Nev.

[73] Assignee: Chromalloy Gas Turbine Corporation, San Antonio, Tex.

[21] Appl. No.: 09/231,057

[22] Filed: Jan. 14, 1999

[51] Int. Cl.[7] ..... C25F 5/00

[52] U.S. Cl. ..... 205/717; 205/723

[58] Field of Search ..... 205/717, 723, 205/718–721

[56] References Cited

U.S. PATENT DOCUMENTS

| | | | |
|---|---|---|---|
| 2,840,521 | 6/1958 | Wasserman | 205/721 X |
| 3,779,879 | 12/1973 | Scott | 205/717 |
| 4,128,463 | 12/1978 | Formanik | 205/717 |
| 4,142,954 | 3/1979 | Lucas | 205/717 X |
| 5,985,127 | 11/1999 | Greenslade | 205/717 X |

*Primary Examiner*—Donald R. Valentine
*Attorney, Agent, or Firm*—Mitchell D. Bittman

[57] ABSTRACT

A process is provided to strip a metallic coating from a turbine blade comprising attaching the blade to a positive lead from a power supply, submersing a portion of the blade with a metallic coating to be stripped into a bath of acidic electro stripping solution, said bath containing a negative lead from a power supply attached to a conductive grid; and providing a current to the blade in the bath for a period of time effective to remove the coating on the portion of the blade.

10 Claims, No Drawings

ELECTROCHEMICAL STRIPPING OF TURBINE BLADES

During the repair of high pressure turbine blades of gas turbine engines, the coating or a portion of the coating must be removed in order to produce a good weld repair. A common procedure for removing the coating is through mechanical means. An example of this process is grit blasting. The major process limitation of grit blast is that it is a line of sight process. When grit blasting to remove coating some areas are shadowed due to part geometry, while other areas suffer excess material removal. The second process limitation is that grit blast is insensitive to coating thickness, coating type, and base metal composition. Consequently, grit blast will remove too much material from some areas, while not completely removing coating from other areas. This is especially important considering that most high pressure turbine blade hardware is extremely thin to start, so any excess material removal can render a part scrap. Process control during grit blast is also a problem. There are many consumable items that are constantly changing and cause the process to change. Due to the process limitations and process control issues, robotic and hand grit blast to remove coating results in both scrap and rework. The scrap is found at ultrasonic wall thickness inspection when blades measure under minimum. Also, during welding thin wall conditions contribute to meltdown and base metal cracking.

Another method of coating removal is to chemically strip a turbine part in an acid bath, such as nitric and phosphoric acid. However, precise control of coating removal to avoid affecting the wall thickness of the base material of a blade is difficult. These prior art acid stripping processes are also time consuming, typically taking 2–8 hours (see U.S. Pat. Nos. 4,176,433 and 5,813,118).

A fast, reliable stripping method is needed to remove coatings without reducing wall thickness.

SUMMARY

Briefly, a process is provided for stripping a metallic coating from a turbine blade comprising attaching the blade to a positive lead from a power supply, submersing a portion of the blade with a metallic coating to be stripped into a bath of acidic electro stripping solution, said bath containing a negative lead from a power supply attached to a conductive grid; and providing a current to the blade in the bath for a period of time effective to remove the coating on the portion of the blade.

DETAILED DESCRIPTION

In the electrochemical stripping process of this invention, each blade part is fixed and connected to a positive lead from a power supply, with the negative lead attached to a shaped grid (e.g. a titanium alloy grid) with the geometry tailored to the blade part configuration to provide uniform coating removal while avoiding localized wall thickness reduction. The shape of the grid will generally correspond to the shape of the portion of the blade to be stripped. The blade is suspended above the bath of acidic electro stripping solution with the portion to be stripped immersed in the bath. The acidic stripping solution can be nitric, hydrochloric, sulfuric, phosphoric or a combination of acids designed to strip a particular coating, from a particular base metal. A salt, such a NaCl, can be added for improved electrical conductivity. The exact chemistry of the bath must be adjusted depending upon the exact coating and base metal combination. Current is applied to the blade for a predetermined length of time to remove all the coating from the localized region. Generally, for typically sized aeroengine turbine blades a current of 3 to 20 amps, preferably 5 to 10 amps, a voltage of 0.5 to 5 volts/part, preferably 1 to 3 volts/part, a bath temperature of from 40° F. to 200° F., preferably room temperature for a time of from 30 seconds to 10 minutes, preferably 3 to 6 minutes is utilized. The process parameters are related to coating thickness and blade size and must be adjusted accordingly for each configuration blade.

The process can advantageously be carried out for localized coating removal, preferably the tip area of the blade; however, it can also be used to remove the complete coating by submerging the entire part in the acid bath. Maskants such as tape or wax as are typically utilized in electrochemical plating solutions can be utilized to mask portions of the blade from being stripped. Beneficially, the portion of the blade above the bath generally will not require masking due to the short overall cycle time.

The process of this invention provides for: coating removal in less time resulting in a higher through put of parts; higher repair yields due to the nature of the coating removal; uniform coating removal; number of parts scrapped during repair is lower; removal of coating can be varied along the length of the blade; and wall thickness of the base metal is kept intact.

EXAMPLE 1

A CFM56 high pressure turbine blade having a Rene 125 base metal with an aluminide coating was subjected to coating removal by having 0.002" to 0.003" of coating removed from the tip region of the blade. Nine or less blades are racked and inverted with tips down. A continuously flowing bath of nitric acid ($HNO_3$), salt (NaCl), and water is in intimate contact with the blade tips and adjusted to a level to remove the coating from approximately the top 0.100" to 0.150" of the tip. The solution is under constant agitation and maintained at 75° F. At the start of the cycle, current is applied to the part in the range of 5 amperes per part with a voltage on the part of 1.5 to 2.5 volts. The process cycle continues for 5 minutes, at which time, the current is dropped to zero. The parts are removed from the acid, rinsed, and back flushed in 150° F. water to remove any residual stripping solution. This process consistently removes 0.002" to 0.003" of coating from the blades, without damaging the base metal or causing intergranular attack (IGA). Material removal amounts are determined by either ultrasonic wall thickness inspection or metallographic analysis.

EXAMPLE 2

A CF6-80C2 second stage high pressure turbine blade having a Rene 80 base metal with a platinum aluminide coating was subjected to coating removal by having 0.002" to 0.003" of coating removed from the tip region of the blade. Nine or less blades are racked and inverted with tips down. A continuously flowing bath of hydrochloric acid (HCl), and water is in intimate contact with the blade tips and adjusted to a level to remove the coating from approximately the top 0.150" to 0.200" of the tip. The solution is under constant agitation and maintained at 75° F. At the start of the cycle, current is applied to the part in the range of 6 amperes per part with a voltage on the part of 1.5 to 2.5 volts. The process cycle continues for 6 minutes, at which time, the current is dropped to zero. The parts are removed from the acid, rinsed, and back flushed in 150° F. water to remove any residual stripping solution. This process consistently removes 0.002" to 0.003" of coating from the blades, without damaging the base metal or causing intergranular attack (IGA). Material removal amounts are determined by either ultrasonic wall thickness inspection or metallographic analysis.

What is claimed is:

1. A process for stripping a metallic coating from a turbine blade of a gas turbine engine comprising:

attaching the blade to a positive lead from a power supply;

submerging a portion of the blade with a metallic coating to be stripped into a bath of acidic electro stripping solution, said bath having a negative lead from the power supply attached to a conductive grid, wherein the shape of the conductive grid is tailored to the blade shape to provide uniform coating removal while avoiding localized wall thickness reduction; and providing a current to the blade in the bath for a period of time effective to remove the coating from the portion of the blade.

2. Process of claim 1 wherein the coating is removed without reducing the wall thickness of the blade.

3. Process of claim 2 wherein the coating thickness removed is from 0.001 to 0.006 inches.

4. Process of claim 3 wherein the power supply provides a current of 3 to 20 amps at a voltage of 0.5 to 5 volts per blade.

5. Process of claim 4 wherein the current is applied for a period of time of 30 seconds to 10 minutes.

6. Process of claim 2 wherein the acidic electro stripping solution is selected from the group consisting of nitric acid, sulfuric acid, hydrochloric acid, phosphoric acid and combinations thereof.

7. Process of claim 2 wherein a maskant is applied to the blade to protect portions of the blade from being stripped.

8. Process of claim 2 wherein the entire blade is submersed in the bath.

9. Process of claim 2 wherein the blade tip is submersed in the bath.

10. Process of claim 1 wherein the shape of the grid corresponds to the shape of the portion of the blade to be stripped.

* * * * *